US008851909B2

(12) United States Patent
Shammoh

(10) Patent No.: US 8,851,909 B2
(45) Date of Patent: Oct. 7, 2014

(54) RETRACTABLE UNIVERSAL ELECTRIC WALL OUTLET

(71) Applicant: Ali A. A. J. Shammoh, Al-Adan (KW)

(72) Inventor: Ali A. A. J. Shammoh, Al-Adan (KW)

( * ) Notice: Subject to any disclaimer, the term of this patent is extended or adjusted under 35 U.S.C. 154(b) by 30 days.

(21) Appl. No.: 13/647,265

(22) Filed: Oct. 8, 2012

(65) Prior Publication Data

US 2014/0099821 A1 Apr. 10, 2014

(51) Int. Cl.
*H01R 13/44* (2006.01)

(52) U.S. Cl.
USPC ..... 439/134

(58) Field of Classification Search
USPC ..... 439/131, 535–544
See application file for complete search history.

(56) References Cited

U.S. PATENT DOCUMENTS

| | | | | |
|---|---|---|---|---|
| 5,575,668 | A * | 11/1996 | Timmerman | 439/131 |
| 6,231,358 | B1 * | 5/2001 | Kerr et al. | 439/140 |
| 6,468,095 | B2 * | 10/2002 | Kerr et al. | 439/140 |
| 6,478,587 | B2 * | 11/2002 | Sharples | 439/131 |
| 6,942,502 | B2 * | 9/2005 | Sharples | 439/131 |
| 7,605,330 | B1 * | 10/2009 | Black et al. | 174/54 |
| 8,158,883 | B2 * | 4/2012 | Soffer | 174/50 |
| 2002/0127897 | A1 * | 9/2002 | Sharples | 439/131 |
| 2003/0054680 | A1 * | 3/2003 | Ross | 439/131 |
| 2010/0157524 | A1 * | 6/2010 | Soffer | 361/679.58 |

FOREIGN PATENT DOCUMENTS

| | | |
|---|---|---|
| CN | 202067968 U | 12/2001 |
| CN | 201038482 Y | 3/2008 |

* cited by examiner

*Primary Examiner* — Chandrika Prasad
(74) *Attorney, Agent, or Firm* — Richard C Litman

(57) ABSTRACT

The retractable universal electrical wall outlet is a wall outlet unit that is designed to include multiple ports for providing power to a variety of devices. The ports may include a telephone jack, a USB port, a DSL/LAN port, and a cable jack. The unit also incorporates therein a power switch, a safety switch, and a digital screen for displaying the amperage consumption and the temperature at the unit's location. A retractable member may be deployed to expose additional ports.

10 Claims, 4 Drawing Sheets

RETRACTABLE UNIVERSAL ELECTRIC WALL OUTLET

BACKGROUND OF THE INVENTION

1. Field of the Invention

The present invention generally relates to electrical appliances, and particularly to a retractable universal electric wall outlet having multiple power receptacle ports.

2. Description of the Related Art

Usually, electrical wall outlets are provided with no more than two power ports, and these ports are usually designed to receive the conventional blades or prongs of an AC (alternating current) power cord. If more devices and/or devices requiring other than AC power outlets are to be used, a separate power strip or distributor must be acquired to receive the additional and/or varied power cords. Besides the additional costs incurred, the use of additional power strips or distributors often presents an unsightly, tangled mess. Providing multiple and varied outlet ports in a single wall outlet would certainly be a popular acquisition for persons that utilize multiple devices (computers, phones, TVs, etc.). Thus, a retractable universal electric wall outlet solving the aforementioned problems is desired.

SUMMARY OF THE INVENTION

The retractable universal electric wall outlet is a wall outlet unit that is designed to include multiple ports for providing power to a variety of devices having diverse power requirements. The ports may include (but are not limited to) a telephone jack, a USB port, a DSL/LAN port and a cable jack. The unit also incorporates therein a power switch, a safety switch, and a digital screen for displaying the amperage consumption and the temperature at the unit's location. The necessary electrical wiring components are housed within the wall, as is conventional. A movable member may be deployed, if desired, to expose additional ports. The unit may be designed to handle either 110 or 240 volts.

Accordingly, the invention presents a versatile wall outlet unit that permits the use of multiple and varied power output ports and allows additional ports to be exposed for use if required. The outlet also incorporates multiple safety features. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
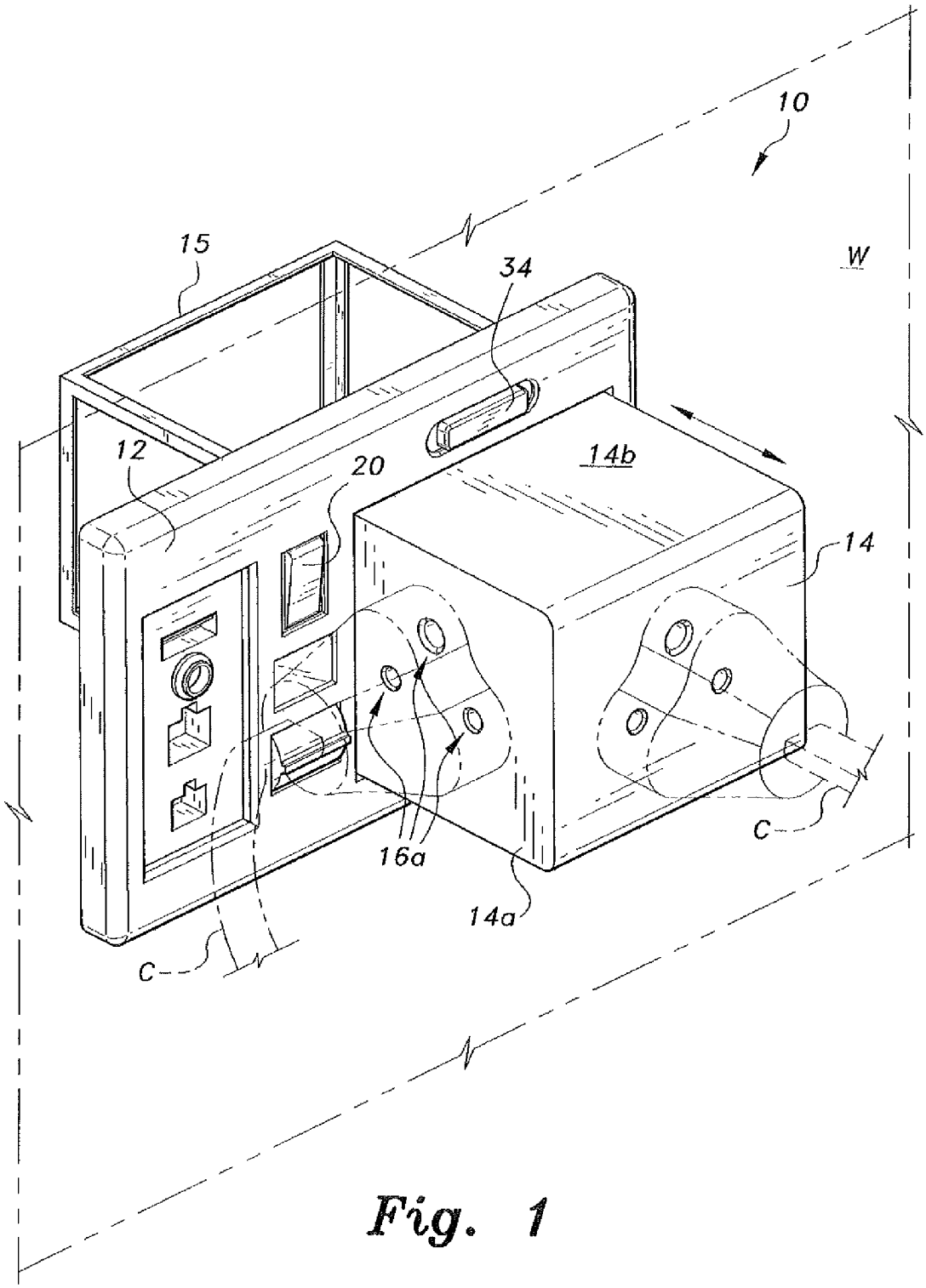
FIG. 1 is an environmental perspective view of a retractable universal electric wall outlet according to the present invention, shown with the movable member in an extended position.
Figure 2:
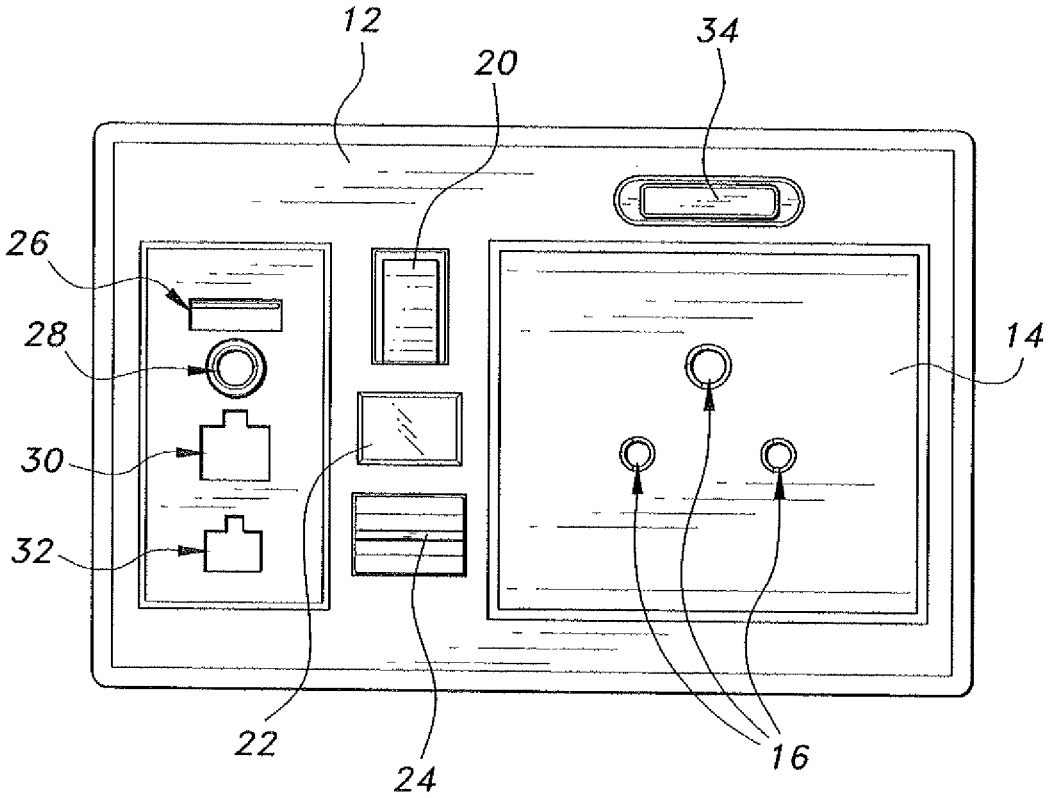
FIG. 2 is a front view of a retractable universal electric wall outlet according to the present invention, shown with the movable member in a retracted position.
Figure 3:
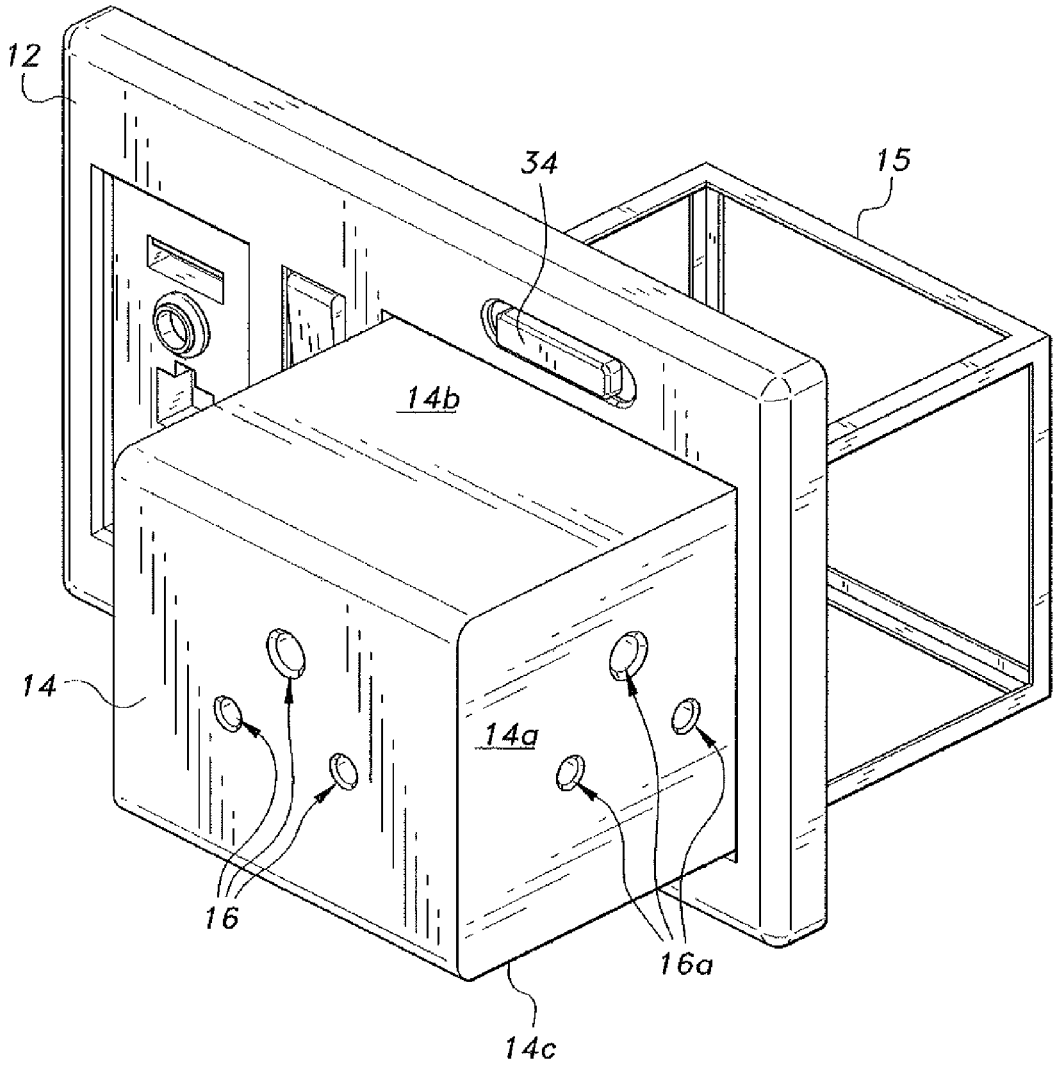
FIG. 3 is a perspective view of a retractable universal electric wall outlet according to the present invention, shown with the movable member in an extended position, but shown from the opposite side from FIG. 1.
Figure 4:
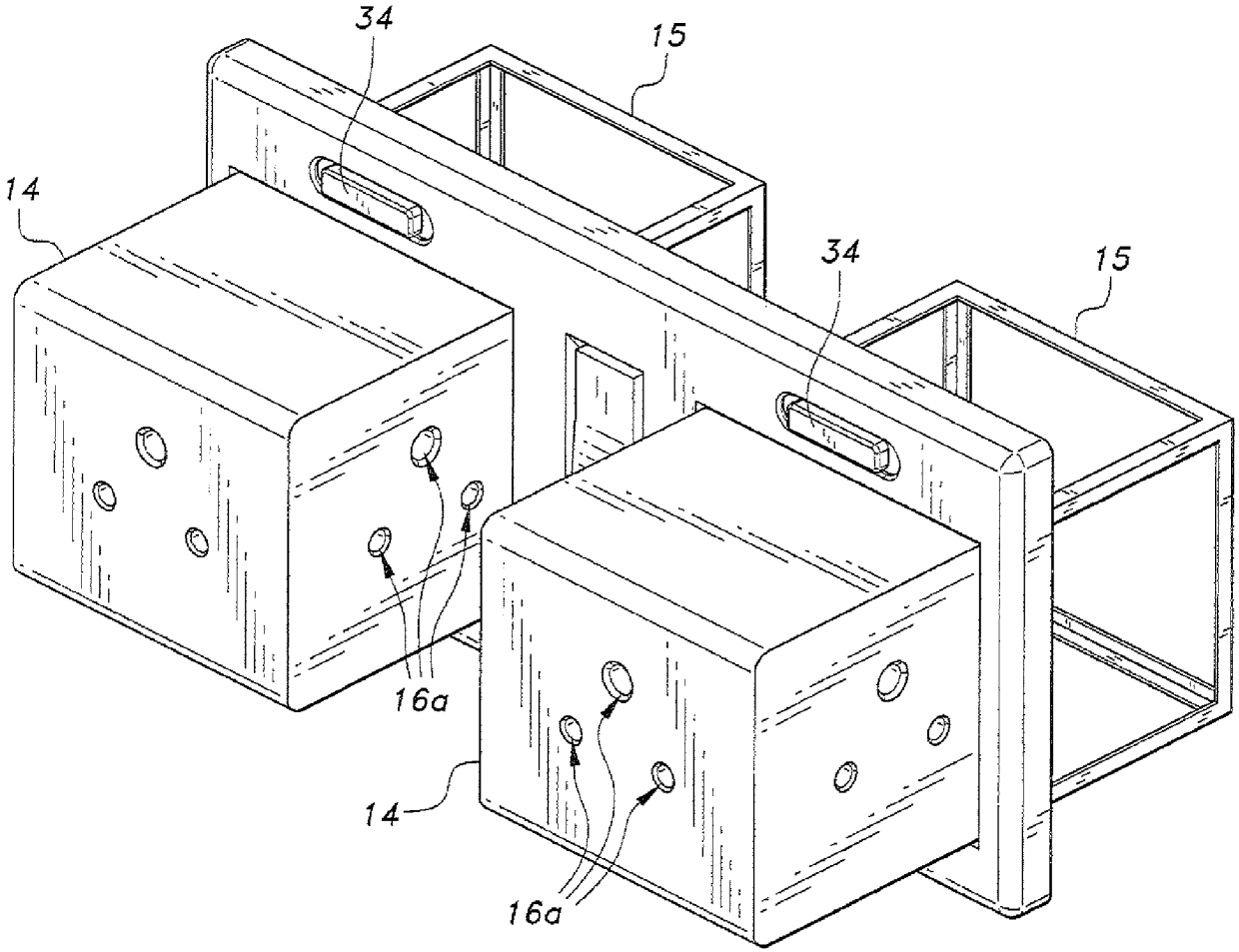
FIG. 4 is a perspective view of an alternative embodiment of a retractable universal electric wall outlet according to the present invention, shown with multiple movable members in extended positions.

With reference to FIGS. 1-4, the retractable universal electric wall outlet is generally indicated at 10. The outlet 10 is mounted in a wall W (shown in phantom lines) in the usual manner. The outlet 10 includes a front face 12. An opening is provided in the front face 12 to receive a movable member 14 therein. The movable member 14 can optionally be extended from the face 12 to expose sidewalls 14*a*, top wall 14*b* and bottom wall 14*c* of the movable member 14. In its retracted position, the body of the movable member 14 is nested within a frame 15, which is disposed in the space behind the wall W, and the front face of the movable member 14 is substantially flush with the front face 12 of the outlet (see FIG. 2). The front face of the movable member 14 is provided with an AC power receptacle 16.

The front face 12 of the outlet 10 includes an array of safety devices and outlet ports for receiving a variety of receptacles. An on/off power switch to activate or deactivate the unit is indicated at 20. A digital screen 22 displays the amperage being utilized and the temperature of the area surrounding the switch. A short circuit safety switch is provided at 24. A USB port, a cable/satellite jack, an ADSL/LAN jack, and a telephone jack are provided at 26, 28, 30 and 32 respectively. As noted above, the outlet ports may be arranged and selected to accommodate other different and varied devices, if desired.

A spring mechanism (not shown) is utilized to extend the movable member 14 to expose the side surfaces 14*a*, top surface 14*b* and bottom surface 14*c* when the member 14 is released from the confines of a mounting wall W. A push button 34 functions to activate the spring mechanism to extend the movable member 14. As illustrated, additional AC power receptacles 16*a* are positioned on the side surfaces 14*a* to receive power cords C. It should be noted, however, that the receptacles 16*a* could be of other types, if desired. It should also be noted that additional receptacles could be provided for the top and bottom surfaces 14*b* and 14*c*. The variation shown in FIG. 4 incorporates two movable members 14 to provide additional flexibility for a user.

Operation of the above described outlet merely requires the manipulation of push button 34 to extend the movable member 14 so that additional ports are exposed. The movable member 14 can be pushed back into the wall to assume its non-retracted position.

It is to be understood that the present invention is not limited to the embodiments described above, but encompasses any and all embodiments within the scope of the following claims.

I claim:

1. A retractable universal electrical wall outlet box for mounting to a wall of a building structure, the wall outlet box comprising:

a plate member adapted to be mounted on the wall, the plate member having a front face, the front face having an opening therethrough;

a first plurality of electrical outlets positioned on the front face of the plate member;

wherein at least one of the first plurality of electrical outlets being a LAN connection;

a movable member mounted in the opening, the movable member being optionally movable in a direction towards and away from the front face;

a second plurality of electrical outlets disposed on the movable member; and a plurality of safety devices positioned on the front face of the plate member;

wherein at least one of the plurality of safety devices being a digital screen;

wherein the plurality of safety devices provide protection for the first and second pluralities of electrical outlets; and wherein movable member has a front surface, and a plurality of side surfaces, the side surfaces being concealed until the movable member is moved in the direction away from the front face, the second plurality of electrical outlets being disposed on the movable member such that at least one of the outlets being disposed on the front surface.

2. The electrical outlet according to claim 1, wherein the first plurality of electrical outlets includes a USB port, a cable/satellite jack, an ADSL jack, and a telephone jack.

3. The electrical outlet according to claim 1, wherein the plurality of safety devices includes an on/off power switch, and a short circuit safety switch;

wherein the digital screen provides operational conditions of the electrical outlet.

4. The electrical outlet according to claim 1, further including a push button disposed on the front face for activating the movable member.

5. An electrical outlet box for mounting to a wall of a building structure, comprising:

a plate member adapted to be mounted on the wall, the plate member having a front face, the front face having at least one opening therethrough;

a first plurality of electrical outlets positioned on the front face of the plate member;

wherein at least one of the electrical outlets being a LAN connection;

a movable member mounted in the opening, the movable member having a front surface and side surfaces and being optionally movable in a direction towards and away from the front face;

a second plurality of electrical outlets disposed on the movable member; and a plurality of safety devices positioned on the front face of the plate member;

wherein movable member has a front surface, and a plurality of side surfaces, the side surfaces being concealed until the movable member is moved in the direction away from the front face, the second plurality of electrical outlets being disposed on the movable member such that at least one of the outlets being disposed on the front surface; and wherein the plurality of safety devices, selectively, automatically and manually control the first and second pluralities of electrical outlets;

whereby a plurality of electrical and environmental parameters are monitored.

6. The outlet according to claim 5 wherein the second plurality of electrical outlets being disposed on the front and side surfaces of the movable member.

7. The electrical outlet according to claim 5, wherein the first plurality of outlets includes a USB port, a cable/satellite jack, an ADSL jack, and a telephone jack.

8. The electrical outlet according to claim 5, wherein the plurality of safety devices includes an on/off power switch, a digital screen for providing an indication of the operating conditions of the electrical outlet, and a short circuit safety switch.

9. The electrical outlet according to claim 5, further including a push button disposed on the front face for activating the movable member.

10. An electrical outlet box for mounting to a wall of a building structure, the electrical outlet box consisting of:

a plate member adapted to be mounted on the wall, the plate member having a front face, the front face having at least one opening therethrough;

a first plurality of electrical outlets positioned on the front face of the plate member, the first plurality of outlets including a USB port, a cable/satellite jack, an ADSL/LAN jack, and a telephone jack;

a second plurality of electrical outlets;

a plurality of safety devices positioned on the front face of the plate member, the plurality of safety devices including an on/off power switch, a digital screen for providing an indication of the operating conditions of the electrical outlet, and a short circuit safety switch;

wherein the plurality of safety devices monitor a plurality of electrical and environmental parameters; and a first movable member mounted in the opening, the first movable member having a front surface and side surfaces and being optionally movable in a direction towards and away from the front face;

a first push button disposed on the front face for activating the first movable member;

wherein the second plurality of electrical outlets are disposed on the first movable member;

wherein the first movable member has a front surface, and a plurality of side surfaces, the side surfaces being concealed until the movable member is moved in the direction away from the front face, the second plurality of electrical outlets being disposed on the first movable member such that at least one of the outlets is disposed on the front surface;

a second opening formed in the front face;

a second movable member mounted in the second opening, the second movable member having a front surface and side surfaces and being optionally movable in a direction towards and away from the front face;

a second push button disposed on the front face for activating the second movable member;

wherein another second plurality of electrical outlets are disposed on the front and side surfaces of the second movable member; and wherein the second movable member has a front surface, and a plurality of side surfaces, the side surfaces being concealed until the second movable member is moved in the direction away from the front face, the another second plurality of electrical outlets being disposed on the second movable member such that at least one of the outlets is disposed on the front surface.

* * * * *